US009714646B2

(12) United States Patent
Shirafuji et al.

(10) Patent No.: US 9,714,646 B2
(45) Date of Patent: Jul. 25, 2017

(54) CAPACITY CONTROL VALVE

(71) Applicant: EAGLE INDUSTRY CO., LTD., Minato-ku, Tokyo (JP)

(72) Inventors: Keigo Shirafuji, Tokyo (JP); Toshinori Kanzaki, Tokyo (JP); Naoki Nishimura, Tokyo (JP); Hideki Higashidozono, Tokyo (JP)

(73) Assignee: EAGLE INDUSTRY CO., LTD., Tokyo (JP)

( * ) Notice: Subject to any disclaimer, the term of this patent is extended or adjusted under 35 U.S.C. 154(b) by 205 days.

(21) Appl. No.: 14/419,448

(22) PCT Filed: Dec. 4, 2013

(86) PCT No.: PCT/JP2013/082536
§ 371 (c)(1),
(2) Date: Feb. 3, 2015

(87) PCT Pub. No.: WO2014/091975
PCT Pub. Date: Jun. 19, 2014

(65) Prior Publication Data

US 2015/0211506 A1 Jul. 30, 2015

(30) Foreign Application Priority Data

Dec. 12, 2012 (JP) ..... 2012-271696

(51) Int. Cl.
*F04B 27/18* (2006.01)
*F25B 49/02* (2006.01)

(52) U.S. Cl.
CPC .. *F04B 27/1804* (2013.01); *F04B 2027/1813* (2013.01); *F04B 2027/1827* (2013.01);
(Continued)

(58) Field of Classification Search
CPC ..... F04B 27/1804; F04B 2027/1827; F04B 2027/1813; F04B 2027/1859;
(Continued)

(56) References Cited

U.S. PATENT DOCUMENTS 4,815,300 A * 3/1989 Suzuki ..... F04B 27/1804 62/209
4,848,101 A * 7/1989 Suzuki ..... F04B 27/1804 251/129.08

(Continued)

FOREIGN PATENT DOCUMENTS

JP 2000345961 A 12/2000
JP 2001132632 A 5/2001

(Continued)

OTHER PUBLICATIONS

Notification of Transmittal of Translation of the International Preliminary Report on Patentability (PCT/IB/338) mailed Jun. 25, 2015, with International Preliminary Report on Patentability (PCT/IB/373) and Written Opinion of the International Searching Authority (PCT/ISA/237), for corresponding international application PCT/JP2013/082536.

(Continued)

*Primary Examiner* — Nathan Zollinger
(74) *Attorney, Agent, or Firm* — Law Office of Katsuhiro Arai

(57) ABSTRACT

A capacity control valve includes: intake-side passages connecting an intake chamber that takes in fluid and a control chamber; a pressure-sensitive chamber formed midway along the intake-side passages; a liquid-refrigerant discharge valve that receives the pressure of the control chamber to open and close the intake-side passages; a pressure-sensitive body placed in the pressure-sensitive chamber, which extends to apply a biasing force to the liquid-refrigerant discharge valve in the direction of closing (Continued)

the valve, while contracting as the ambient pressure increases; and a solenoid that applies an electromagnetic drive force to control the main valve; wherein the pressure-sensitive body is supported on one side by the driving rod of the solenoid in a manner permitting relative motion, while connected on the other side to the liquid-refrigerant discharge valve, wherein the discharge valve structure and discharge flow passages for discharging liquid refrigerant are simplified.

4 Claims, 7 Drawing Sheets

(52) U.S. Cl.
CPC ..... *F04B 2027/1831* (2013.01); *F04B 2027/1854* (2013.01); *F04B 2027/1886* (2013.01); *F25B 49/022* (2013.01)

(58) Field of Classification Search
CPC ..... F04B 2027/1845; F04B 2027/1831; F04B 2027/1895; F04B 27/18; F04B 2027/1854; F04B 2027/1886; F16K 31/06–31/0641; F25B 49/022
USPC ..... 417/222.2; 62/228.2
See application file for complete search history.

(56) References Cited

U.S. PATENT DOCUMENTS

| | | | | |
|---|---|---|---|---|
| 4,894,999 | A * | 1/1990 | Kaiju | B60H 1/321 62/158 |
| 6,354,811 | B1 * | 3/2002 | Ota | F04B 27/1804 137/596.17 |
| 6,361,283 | B1 | 3/2002 | Ota et al. | |
| 9,181,937 | B2 * | 11/2015 | Ota | F04B 27/1804 |
| 2008/0138213 | A1 | 6/2008 | Umemura et al. | |
| 2009/0183786 | A1 | 7/2009 | Iwa et al. | |
| 2009/0283164 | A1 | 11/2009 | Cho et al. | |

FOREIGN PATENT DOCUMENTS

| | | | |
|---|---|---|---|
| JP | 2013144957 | A | 7/2013 |
| WO | 2006090760 | A1 | 8/2006 |
| WO | 2006137270 | A1 | 12/2006 |
| WO | 2007119380 | A1 | 10/2007 |

OTHER PUBLICATIONS

International Search Report (ISR) mailed Feb. 18, 2014, issued for international application No. PCT/JP2013/082536.
A First Notification of Reason for Refusal issued by the State Intellectual Property Office of China, mailed Mar. 3, 2016, for Chinese counterpart application No. 201380041470.6.

* cited by examiner

[FIG. 1]
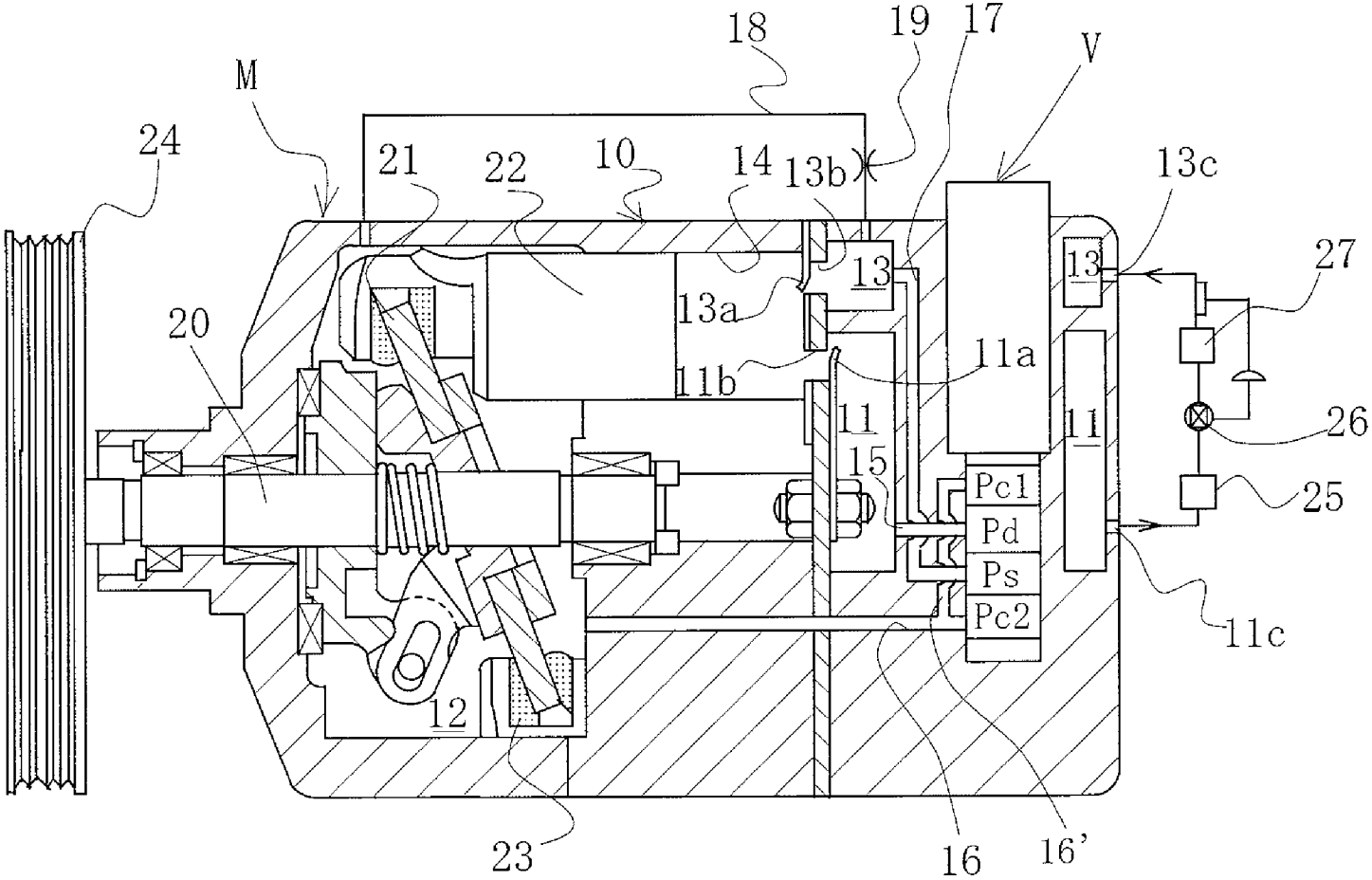

[FIG. 2]
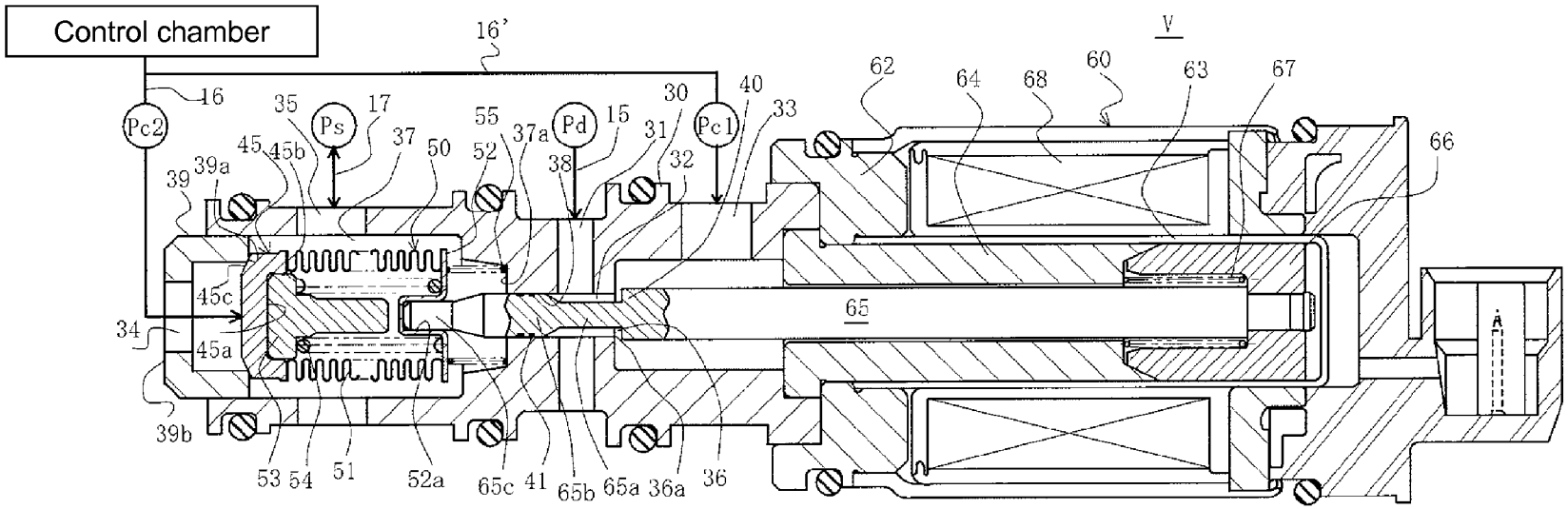

[FIG. 3]
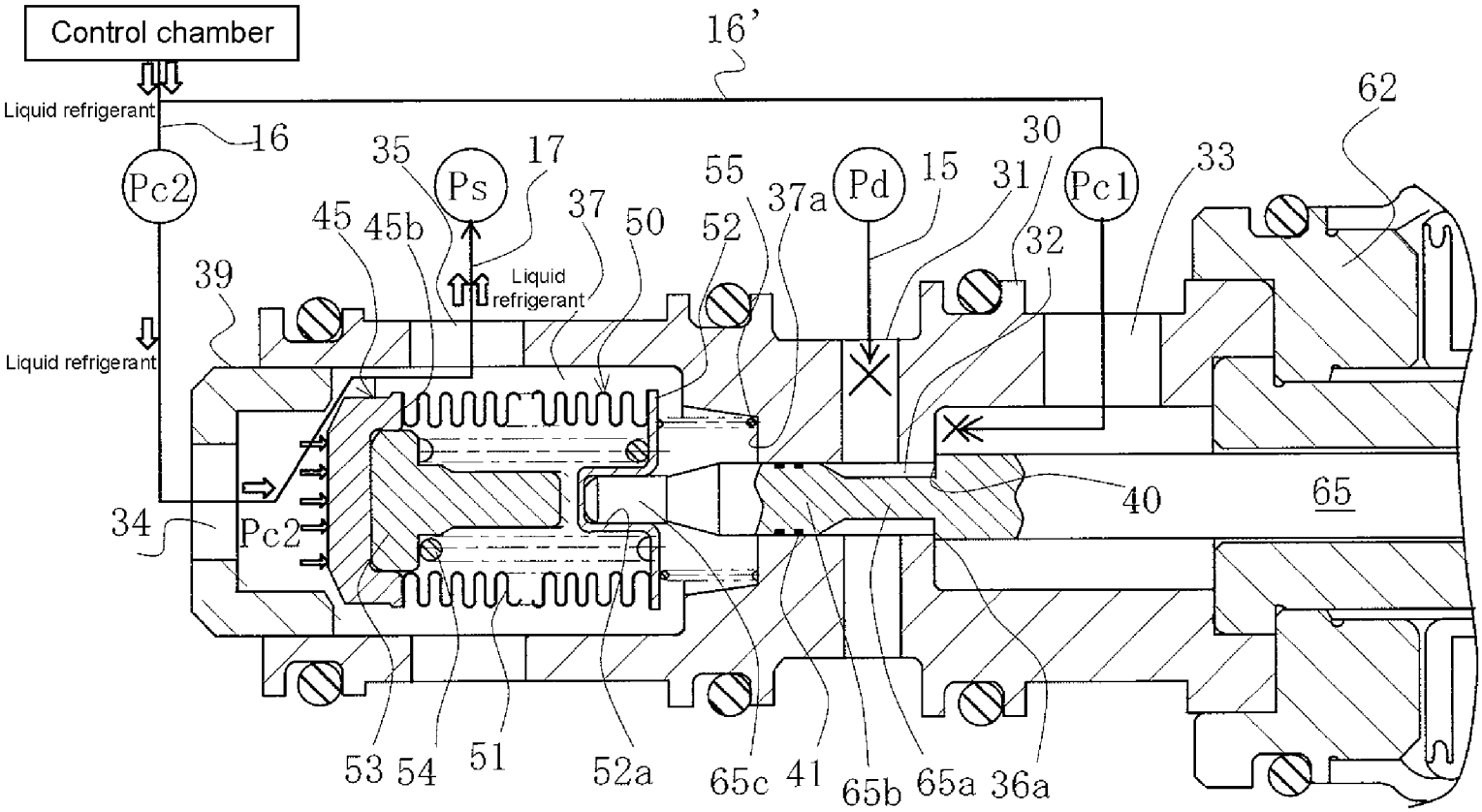

[FIG. 4]
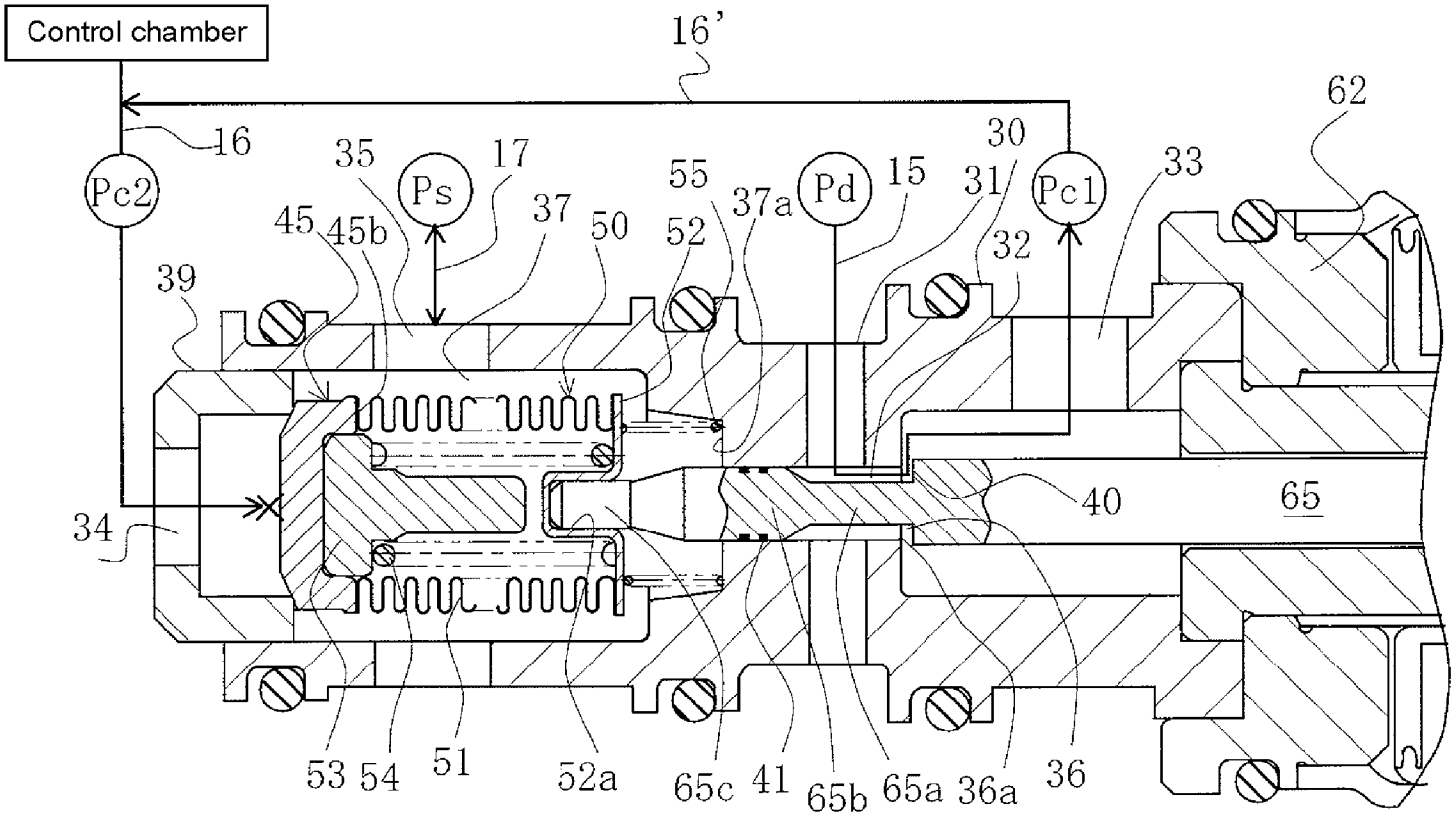

[FIG. 5]
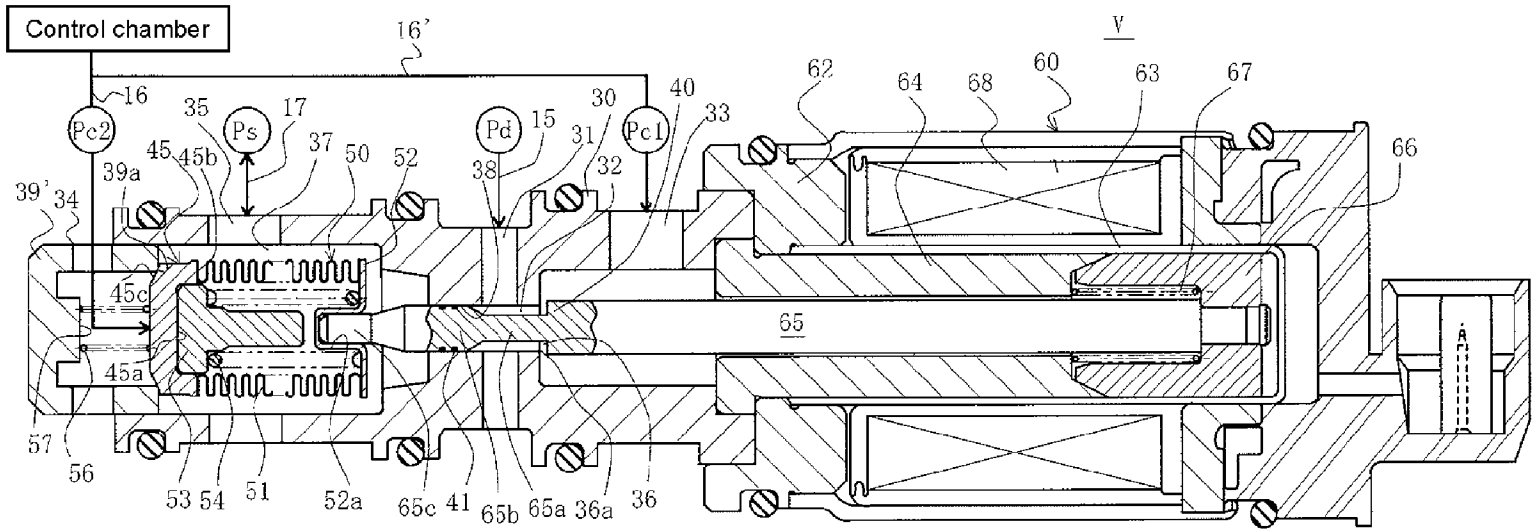

[FIG. 6]
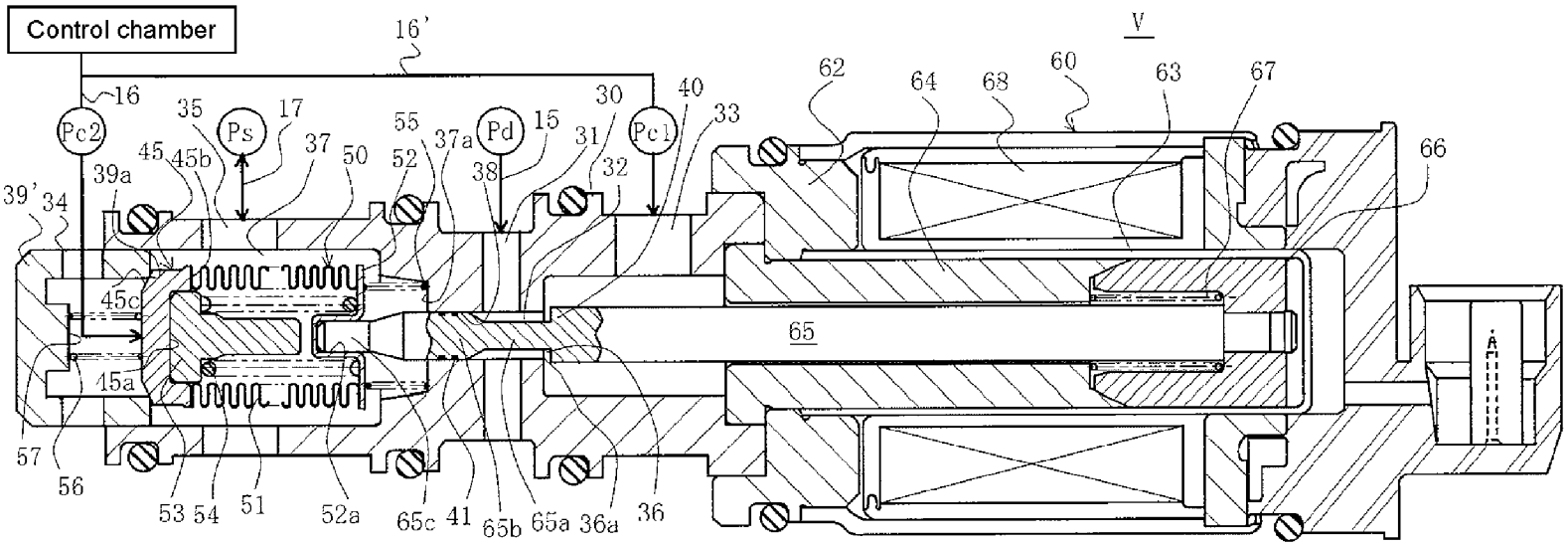

[FIG. 7]
Background Art
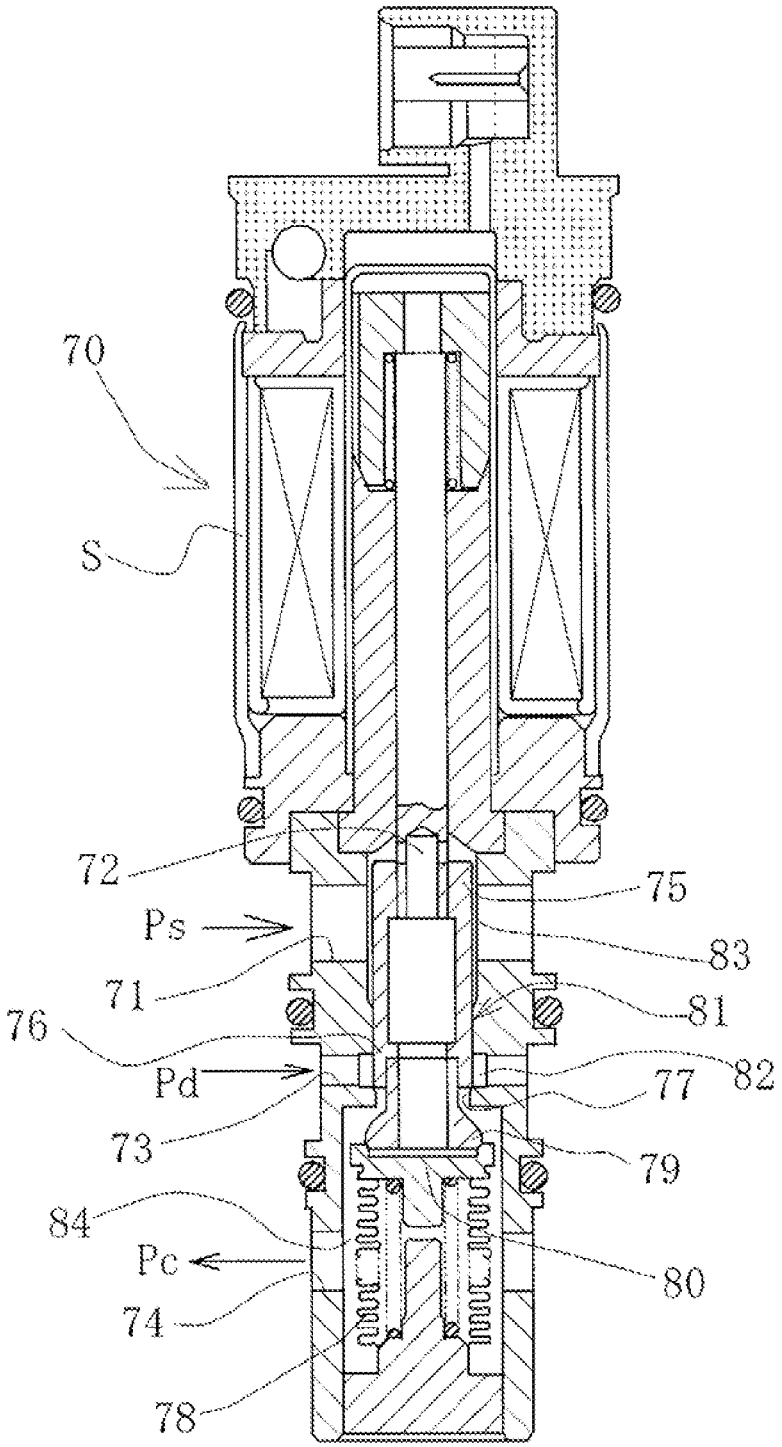

CAPACITY CONTROL VALVE

This application is the U.S. National Phase under 35 U.S.C. §371 of International Application PCT/JP2013/082536, filed Dec. 4, 2013, which claims priority to Japanese Patent Application No. 2012-271696, filed Dec. 12, 2012. The International Application was published under PCT Article 21(2) in a language other than English.

TECHNICAL FIELD

The present invention relates to a capacity control valve that variably controls the capacity or pressure of working fluid, and more specifically to a capacity control valve that controls the discharge rate, according to the pressure load, of a variable-capacity compressor, etc., used for air-conditioning systems for automobiles, etc.

BACKGROUND ART

A swash-plate type variable-capacity compressor used for air-conditioning systems for automobiles, etc., is equipped with, among others, a rotational shaft that rotates by being driven by the rotational force of the engine, a swash plate connected to the rotational shaft at a variable tilt angle, and a compression piston connected to the swash plate, wherein the tilt angle of the swash plate is changed in order to change the piston stroke and thereby control the discharge rate of the refrigerant gas.

The tilt angle of the swash plate can be changed continuously by adjusting the state of balance between the pressures acting upon both sides of the piston, which is in turn achieved by controlling the pressure in a control chamber as appropriate by using a capacity control valve that utilizes the intake pressure of an intake chamber into which refrigerant gas is taken in, the discharge pressure of a discharge chamber from which piston-pressurized refrigerant gas is discharged, and the control chamber pressure of a control chamber (crank chamber) in which the swash plate is housed, while also opening and closing by being driven by electromagnetic force.

One such capacity control valve is known, which, as shown in FIG. 7, comprises: discharge-side passages 73, 77 connecting the discharge chamber and control chamber; a first valve chamber 82 formed midway along the discharge-side passages; intake-side passages 71, 72 connecting the intake chamber and control chamber; a second valve chamber (actuation chamber) 83 formed midway along the intake-side passages; a valve element 81 formed in such a way that a first valve 76 placed in the first valve chamber 82 to open and close the discharge-side passages 73, 77, and a second valve 75 placed in the second valve chamber 83 to open and close the intake-side passages 71, 72, undergo reciprocating motion in a unified manner while opening and closing in the opposite directions, respectively; a third valve chamber (capacity chamber) 84 formed midway along the intake-side passages 71, 72 near the control chamber; a pressure-sensitive body (bellows) 78 placed in the third valve chamber to apply a biasing force in the extending (expanding) direction while contracting as the ambient pressure increases; a valve seat body (engagement part) 80 provided at the free end of the pressure-sensitive body in the extending/contracting direction and having a ring-shaped seating surface; a third valve (valve-opening connection part) 79 that moves integrally with the valve element 81 in the third valve chamber 84 and is able to open and close the intake-side passages by engaging with and separating from the valve seat body 80; and a solenoid S, etc., that applies an electromagnetic drive force to the valve element 81 (hereinafter referred to as "prior art"; refer to Patent Literatures 1 and 2, for example).

Then, this capacity control valve 70 is such that, when a need arises to change the control chamber pressure, the pressure (control chamber pressure) Pc in the control chamber can be adjusted by connecting the discharge chamber and control chamber without having to provide the variable-capacity compressor with a clutch mechanism for capacity control. The valve is also constituted in such a way that, if the control chamber pressure Pc rises when the variable-capacity compressor is stopped, the third valve (valve-opening connection part) 79 is separated from the valve seat body (engagement part) 80 to open the intake-side passages, thereby connecting the intake chamber and control chamber.

Now, when the swash-plate type variable-capacity compressor is started after an extended period of non-operation, the set discharge rate cannot be ensured through compression of refrigerant gas unless liquid refrigerant (refrigerant gas that has cooled and liquefied during the non-operational period) collected in the control chamber (crank chamber) is discharged.

So that desired capacity control is implemented immediately after the startup, liquid refrigerant in the control chamber (crank chamber) must be discharged as soon as possible.

With the capacity control valve 70 based on the prior art, first of all, liquid refrigerant collects in the control chamber (crank chamber) of the variable-capacity compressor if the variable-capacity compressor remains non-operational for an extended period of time with the solenoid S turned off and the connection passages (intake-side passages) 71, 72 blocked by the second valve 75. If the variable-capacity compressor remains non-operational longer, pressure equalization occurs inside the variable-capacity compressor and the control chamber pressure Pc becomes much higher than the control chamber pressure Pc and intake chamber pressure Ps when the variable-capacity compressor is being driven.

If the solenoid S is turned on and valve element 81 begins to start in this state, the first valve 76 moves in the valve-closing direction simultaneously as the second valve 75 moves in the valve-opening direction, while liquid refrigerant in the control chamber of the variable-capacity compressor is discharged. Then, the control chamber pressure Pc causes the pressure-sensitive body 78 to contract and the third valve 79 to separate from the valve seat body 80 and open. Here, because the second valve 75 is open and thus the connection passages (intake-side passages) 72, 71 are open, liquid refrigerant in the control chamber is discharged to the intake chamber of the variable-capacity compressor through the connection passages (intake-side passages) 74, 72, 71. Then, when the control chamber pressure Pc drops to the specified level or lower, the pressure-sensitive body 78 restores itself elastically and extends, and the valve seat body 80 engages with the third valve 79 and closes, thereby causing the connection passages (intake-side passages) 74, 72, 71 to be blocked.

However, the prior art is based on a complex structure having the valve seat body (engagement part) 80 provided at the free end of the pressure-sensitive body 78 in the extending/contracting direction and having a ring-shaped seating surface, as well as the third valve (valve-opening connection part) 79 that moves integrally with the valve element 81 in the third valve chamber 84 and is able to open and close the intake-side passages by engaging with and separating from the valve seat body 80, and there is also a limit to how much the discharge of liquid refrigerant can be improved further partly because changing the bore of the third valve 79 is not easy and partly because the liquid-refrigerant discharge flow passages have many windings and turns and are also long and therefore subject to high discharge resistance.

PRIOR ART LITERATURES

Patent Literatures

Patent Literature 1: International Patent Laid-open No. 2006/090760

Patent Literature 2: International Patent Laid-open No. 2007/119380

SUMMARY OF INVENTION

Problems to be Solved by Invention

The present invention was developed to solve the aforementioned problems of the prior art, and an object is to provide a capacity control valve that can improve the function of a variable-capacity compressor to discharge liquid refrigerant from its control chamber, at startup, by simplifying the discharge valve structure and discharge flow passages for discharging liquid refrigerant.

Another object of the present invention is to provide a capacity control valve that allows for discharge of liquid refrigerant while extending the control limits at the same time by making the bore of the liquid-refrigerant discharge valve easily adjustable.

Means for Solving the Problems

Principles

The present invention is characterized in that the discharge-side passages and intake-side passages of the capacity control valve are completely separated, and a liquid-refrigerant discharge valve is provided at one end of the pressure-sensitive body on the opposite side of the main valve, in order to simplify the discharge valve structure and discharge flow passages for discharging liquid refrigerant.

Solving Means

To achieve the aforementioned objects, firstly, a capacity control valve conforming to the present invention is characterized by comprising:

discharge-side passages connecting a discharge chamber that discharges fluid and a control chamber that controls the discharge rate of fluid;

a main valve chamber formed midway along the discharge-side passages;

a main valve that opens and closes the discharge-side passages in the main valve chamber;

intake-side passages connecting an intake chamber that takes in fluid and the control chamber;

a pressure-sensitive chamber formed midway along the intake-side passages;

a liquid-refrigerant discharge valve that receives the pressure of the control chamber to open and close the intake-side passages;

a pressure-sensitive body placed in the pressure-sensitive chamber, which extends to apply a biasing force to the liquid-refrigerant discharge valve in the direction of closing the valve, while contracting as the ambient pressure increases; and a solenoid that applies an electromagnetic drive force to control the main valve;

wherein the pressure-sensitive body is supported on one side by the driving rod of the solenoid in a manner permitting relative motion, while connected on the other side to the liquid-refrigerant discharge valve.

According to these features, the discharge valve structure and discharge flow passages for discharging liquid refrigerant can be simplified and therefore the function of a variable-capacity compressor to discharge liquid refrigerant from its control chamber, at startup, can be improved. In addition, the bore of the liquid-refrigerant discharge valve can be made easily adjustable, which allows for discharge of liquid refrigerant while extending the control limits at the same time.

Furthermore, secondly, a capacity control valve conforming to the present invention is characterized in that, in addition to the first features, an elastic body is provided that pressurizes the liquid-refrigerant discharge valve in the direction of closing the valve.

According to these features, the liquid-refrigerant discharge valve can be prevented from inadvertently opening during continuous variable control operation and disabling the control as a result, even when the solenoid thrust force is low and bellows load is also low.

Furthermore, thirdly, a capacity control valve conforming to the present invention is characterized in that, in addition to the first features, an elastic body is provided that pressurizes the liquid-refrigerant discharge valve in the direction of opening the valve.

According to these features, the liquid-refrigerant discharge valve can be opened by the control chamber pressure to reliably discharge liquid refrigerant, etc., collected in the control chamber, even when the pressure differential between the control chamber pressure and intake chamber pressure, which provides for a condition for discharging liquid refrigerant, is small.

Furthermore, fourthly, a capacity control valve conforming to the present invention is characterized in that, in addition to the first features, an elastic body is provided that pressurizes the liquid-refrigerant discharge valve in the direction of closing the valve, along with an elastic body that pressurizes the liquid-refrigerant discharge valve in the direction of opening the valve.

According to these features, the control range of liquid refrigerant discharge can be expanded, while liquid refrigerant can be discharged reliably.

Effects of Invention

The present invention provides excellent effects as described below.

(1) The pressure-sensitive body is supported on one side by the driving rod of the solenoid in a manner permitting relative motion, while connected on the other side to the liquid-refrigerant discharge valve, and accordingly the discharge valve structure and discharge flow passages for discharging liquid refrigerant can be simplified and therefore the function of a variable-capacity compressor to discharge liquid refrigerant from its control chamber, at startup, can be improved. In addition, the bore of the liquid-refrigerant discharge valve can be made easily adjustable, which allows for discharge of liquid refrigerant while extending the control limits at the same time.

(2) An elastic body is provided that pressurizes the liquid-refrigerant discharge valve in the direction of closing the valve, and accordingly the liquid-refrigerant discharge valve can be prevented from inadvertently opening during continuous variable control operation and disabling the control as a result, even when the solenoid thrust force is low and bellows load is also low.

(3) An elastic body is provided that pressurizes the liquid-refrigerant discharge valve in the direction of opening the valve, and accordingly the liquid-refrigerant discharge valve can be opened by the control chamber pressure to reliably discharge liquid refrigerant, etc., collected in the control chamber, even when the pressure differential between the control chamber pressure and intake chamber pressure, which provides for a condition for discharging liquid refrigerant, is small.

(4) An elastic body is provided that pressurizes the liquid-refrigerant discharge valve in the direction of closing the valve, along with an elastic body that pressurizes the liquid-refrigerant discharge valve in the direction of opening the valve, and accordingly the control range of liquid refrigerant discharge can be expanded further, while liquid refrigerant can be discharged reliably.

BRIEF DESCRIPTION OF DRAWINGS

{FIG. 1} is a schematic block diagram showing a swash-plate type variable-capacity compressor with a capacity control valve pertaining to an example of the present invention.

{FIG. 2} is a front section view showing an embodiment of the capacity control valve pertaining to Example 1 of the present invention.

{FIG. 3} is a drawing explaining the operation of the capacity control valve pertaining to Example 1, being a front section view showing how liquid refrigerant is discharged.

{FIG. 4} is a drawing explaining the operation of the capacity control valve pertaining to Example 1, being a front section view showing a state of continuous variable control.

{FIG. 5} is a front section view showing an embodiment of the capacity control valve pertaining to Example 2.

{FIG. 6} is a front section view showing an embodiment of the capacity control valve pertaining to Example 3.

{FIG. 7} is a front section view showing a capacity control valve based on the prior art.

MODES FOR CARRYING OUT THE INVENTION

Modes for carrying out the present invention are explained below using examples by referring to the drawings. It should be noted, however, that the dimensions, material, shape, relative positions, etc., of components described in these examples are not intended to limit such dimensions, materials, shapes, relative positions, etc., to the foregoing, unless otherwise expressly specified.

EXAMPLE 1

The capacity control valve pertaining to Example 1 of the present invention is explained by referring to FIGS. 1 through 4.

[Swash-plate Type Variable-control Compressor with Capacity Control Valve]

As shown in FIG. 1, a swash-plate type variable-control compressor M is equipped with, among others: a discharge chamber 11; a control chamber (also referred to as "crank chamber") 12; an intake chamber 13; multiple cylinders 14; a port 11*b* that connects the cylinders 14 and discharge chamber 11 and is opened and closed by a discharge valve 11*a*; a port 13*b* that connects the cylinders 14 and intake chamber 13 and is opened and closed by an intake valve 13*a*; a discharge port 11*c* and intake port 13*c* connected to an external cooling circuit; a casing 10 that defines, among others, connection passages 15, 16' 16 that serve as discharge-side passages connecting the discharge chamber 11 and control chamber 12, as well as connection passages 16, 17 that serve as intake-side passages connecting the control chamber 12 and intake chamber 13; a rotational shaft 20 projecting outward from within the control chamber (crank chamber) 12 and provided in a freely rotatable manner; a swash plate 21 that rotates in a unified manner with the rotational shaft 20 and is connected to the rotational shaft 20 at a variable tilt angle; multiple pistons 22 fitted into the respective cylinders 14 in a manner permitting free reciprocating motion; multiple connection members 23 connecting the swash plate 21 and respective pistons 22; a driven pulley 24 attached to the rotational shaft 20; and a capacity control valve V conforming to the present invention which is embedded in the casing 10.

Also provided in the swash-plate type variable-capacity compressor M is a connection passage 18 that directly connects the control chamber (crank chamber) 12 and intake chamber 13, and a fixed orifice 19 is provided in the connection passage 18.

Furthermore, the swash-plate type variable-capacity compressor M has a cooling circuit connected to its discharge port 11*c* and intake port 13*c*, and a condenser 25, expansion valve 26, and evaporator 27 are arranged, in this order, in this cooling circuit.

[Capacity Control Valve]

The capacity control valve in Example 1 is suitable when the pressure differential between the control chamber pressure Pc and intake chamber pressure Ps, which provides for a condition for discharging liquid refrigerant, is large, as well as when the solenoid thrust force is low and bellows load is also low.

The level of the pressure differential between the control chamber pressure Pc and intake chamber pressure Ps, which provides for a condition for discharging liquid refrigerant, is determined by the conditions required of the compressor, while the solenoid thrust force is determined by the capacity of the solenoid itself.

As shown in FIG. 2, the capacity control valve V is equipped with, among others: a body 30 formed by metal material or resin material; a main valve 40 placed in the body 30 in a manner permitting free reciprocating motion; a pressure-sensitive body 50 that biases the main valve 40 in one direction; and a solenoid 60 connected to the body 30 and applying an electromagnetic drive force to the main valve 40.

The body 30 is equipped with, among others: connection passages 31, 32, 33 that function as discharge-side passages; a main valve chamber 36 formed midway along the discharge-side passages; connection passages 34, 35 that function as intake-side passages; a pressure-sensitive chamber 37 formed midway along the intake-side passages; and a guide passage 38 that guides a driving rod 65 (described later) for driving the main valve 40, while cutting off the connection between the pressure-sensitive chamber 37 and discharge-side passages 31, 32, 33. Also fixed onto the body 30 is a liquid-refrigerant discharge valve seat 39 on which is set the connection passage 34 that defines the pressure-sensitive chamber 37 and also functions as an intake-side passage.

The connection passages 34, 35 and pressure-sensitive chamber 37 form the intake-side passages, while the connection passage 32 connects the main valve chamber 36 and the connection passage 31 and also allows the driving rod 65 to be inserted into it (functioning as a valve hole that ensures a clearance through which the fluid flows while allowing the main valve 40 to be guided through it).

Also in the main valve chamber 36, a seating surface 36*a* on which the main valve 40 is seated is formed at the edge of the connection passage (valve hole) 32.

The main valve 40 is formed as part of the driving rod 65, or formed separately from the driving rod 65 and then fixed onto the driving rod 65 integrally with the rod, for example, and separates from or contacts the seating surface 36*a* to disconnect or connect the discharge-side passages.

The solenoid 60 is equipped with, among others: a casing 62 connected to the body 30; a sleeve 63 closed at one end; a cylindrical fixed iron core 64 placed inside the casing 62 and sleeve 63; a driving rod 65 formed inside the fixed iron core 64 in a manner permitting free reciprocating motion, which has the main valve 40 formed midway on its tip side and travels through the guide passage 38 and projects into the pressure-sensitive chamber 37; a movable iron core 66 fixed on the base end side of the driving rod 65; a coil spring 67 that biases the movable iron core 66 in the direction of opening the main valve 40; and an excitation coil 68 wound around the outside of the sleeve 63 via a bobbin.

The driving rod 65 is such that a part 65*a* positioned in the connection passage (valve hole) 32 is formed with a small diameter, while a part 65*b* positioned in the guide passage 38 is formed with a large diameter, while a tip 65*c* projecting into the pressure-sensitive chamber 37 is formed with a small diameter. A seal member 41 is installed over the outer periphery surface of the part 65*b* positioned in the guide passage 38.

The pressure-sensitive body 50 provided in the pressure-sensitive chamber 37 is equipped with, among others: bellows 51; an adapter 52 fixed at the solenoid-side end of the bellows 51; a holder 53 provided on the liquid-refrigerant discharge valve seat 39 side of the bellows 51; and a spring 54 provided between the adapter 52 and holder 53. A liquid-refrigerant discharge valve 45 is connected to the liquid-refrigerant discharge valve seat 39-side end of the pressure-sensitive body 50.

The adapter 52 is shaped like a disc, has a recess 52*a* formed at its center to loosely engage with the tip 65*c* of the driving rod 65, and transmits the thrust of the driving rod 65 (force that pushes the liquid-refrigerant discharge valve 45 toward the liquid-refrigerant discharge valve seat 39 side) to the bellows 51. The adapter 52 and driving rod 65 can move relatively and also independently when the driving rod 65 returns.

This liquid-refrigerant discharge valve 45 opens when liquid refrigerant must be discharged from the control chamber (crank chamber) 12, and is closed during normal operation control.

The liquid-refrigerant discharge valve 45 is shaped like a dish, for example, with the holder 53 engaged with its recess 45a and bellows 51 connected to its edge 45*b*.

The valve is also formed in such a way that a corner 45*c* of its exterior surface at the bottom contacts a valve seat area 39*a* of the liquid-refrigerant discharge valve seat 39.

On the other hand, the liquid-refrigerant discharge valve seat 39 is shaped like a cup, for example, with the valve seat area 39*a* formed at its edge and the connection passage 34 formed at its bottom 39*b*.

Since a seal area is constituted by the corner 45*c* of the exterior surface of the dish-shaped liquid-refrigerant discharge valve 45 and the edge of the cup-shaped liquid-refrigerant discharge valve seat 39, as described above, a large bore can be set for the liquid-refrigerant discharge valve 45 and adjusting the bore is also easy.

An elastic body 55 (such as a coil spring) is provided between the adapter 52 and a solenoid-side interior wall surface 37*a* of the pressure-sensitive chamber 37, and the elastic restoration force of the elastic body 55 biases the liquid-refrigerant discharge valve 45 against the liquid-refrigerant discharge valve seat 39 via the pressure-sensitive body 50. This elastic body 55 biases the liquid-refrigerant discharge valve 45 against the liquid-refrigerant discharge valve seat 39 with the elastic restoration force of the elastic body 55 regardless of the state of extension/contraction of the pressure-sensitive body 50. For example, while the liquid-refrigerant discharge valve 45 may inadvertently open during continuous variable control operation and disable the control when the solenoid thrust force is low and the load generated by the bellows 51 is also low, such contingency situation can be prevented when the elastic body 55 is provided.

The aforementioned constitution is such that, when the coil 68 is not energized, the biasing force of the pressure-sensitive body 50 and coil spring 67 causes the main valve 40 to move to the right and separate from the seating surface 36*a*, as shown in FIG. 2, and the connection passages (discharge-side passages) 31, 32, 33 are open, while the connection passages (intake-side passages) 34, 35 are blocked as the liquid-refrigerant discharge valve 45 contacts the liquid-refrigerant discharge valve seat 39.

If the variable-capacity compressor remains non-operational for an extended period of time with the connection passages (intake-side passages) 34, 35 blocked, liquid refrigerant collects in the control chamber (crank chamber) 12 of the variable-capacity compressor and pressure equalization occurs in the variable-capacity compressor, and the control chamber pressure Pc becomes much higher than the control chamber pressure Pc and intake chamber pressure Ps when the variable-capacity compressor is being driven.

When the coil 68 is energized with the specified or greater current (I), on the other hand, the electromagnetic drive force (biasing force) of the solenoid 60 which acts in the opposite direction to the biasing force of the pressure-sensitive body 50 and coil spring 67 causes the valve body 40 to move to the left and become seated on the seating surface 36*a*, as shown in FIG. 3, and the connection passages (discharge-side passages) 31, 32, 33 are blocked. In this example, the pressure differential between the control chamber pressure Pc and intake chamber pressure Ps, which provides for a condition for discharging liquid refrigerant, is large and therefore the liquid-refrigerant discharge valve 45 is opened by the control chamber pressure Pc immediately after startup, and since the intake-side passages 34, 35 become connected, liquid refrigerant, etc., collected in the control chamber 12 is discharged to the intake chamber 13 through the intake-side passages 34, 35.

The relationship of Pc>Ps is satisfied immediately after startup, so when the effective area of the bellows 51 and effective area of the liquid-refrigerant discharge valve 45 are set to an identical value of A, and the spring force of the elastic body 55 is given by Fspr, then the liquid-refrigerant discharge valve 45 will open so long as A, Pc, Ps and Fspr are set to satisfy the relationship below (note that the above assumes that the bellows 51 is in contact and no spring force is generated):

$$A \cdot Pc > A \cdot Ps + Fspr$$

When liquid refrigerant, etc., is discharged to the intake chamber 13, the intake chamber pressure Ps which was initially low increases and this increased pressure causes the bellows 51 to contract, thereby keeping the liquid-refrigerant discharge valve 45 open. When liquid refrigerant, etc., in the control chamber is discharged and the control chamber pressure Pc drops to the specified level or lower, the liquid-refrigerant discharge valve 45 is seated on the liquid-refrigerant discharge valve seat 39 and closes. Once the liquid-refrigerant discharge valve 45 closes, the intake chamber pressure Ps decreases and the bellows 51 extends, and the liquid-refrigerant discharge valve 45 remains closed.

FIG. 4 illustrates a state of continuous variable control, showing how the main valve 40 is open by a very small angle due to the solenoid 60, while the liquid-refrigerant discharge valve 45 is closed, when the compressor is in a state of continuous variable control. The control chamber pressure Pc and intake chamber pressure Ps are controlled.

If the solenoid 60 thrust force is low and bellows 51 generated load is also low in this state, the liquid-refrigerant discharge valve 45 may open inadvertently during operation control and disable the control; in this example, however, the liquid-refrigerant discharge valve 45 will not open because the elastic body 55 that biases the liquid-refrigerant discharge valve 45 against the liquid-refrigerant discharge valve seat 39 is provided. This prevents the active continuous variable control from being disabled.

EXAMPLE 2

The capacity control valve pertaining to Example 2 of the present invention is explained by referring to FIG. 5. It should be noted that the same members used in Example 1 are given the same symbols and redundant explanations are omitted.

The capacity control valve in Example 2 is suitable when the pressure differential between the control chamber pressure Pc and intake chamber pressure Ps, which provides for a condition for discharging liquid refrigerant, is small, as well as when the solenoid thrust force is high and bellows load is also high.

Example 2 shown in FIG. 5 is characterized in that the elastic body 55 in Example 1 that biases the liquid-refrigerant discharge valve 45 in the direction of closing the valve is omitted, and in that an elastic body 56 that biases the liquid-refrigerant discharge valve 45 in the direction of opening the valve is provided.

In FIG. 5, the elastic body 55 that biases the liquid-refrigerant discharge valve 45 in the direction of opening the valve is provided at a position between the liquid-refrigerant discharge valve 45 and liquid-refrigerant discharge valve seat 39'. The liquid-refrigerant discharge valve seat 39' is shaped like a cup, but it is set deeper than the liquid-refrigerant discharge valve seat 39 in Example 1 and the connection passage (intake-side passage) 34 is provided not at its bottom but on its side face. In addition, a pedestal 57 that supports the elastic body 56 is provided on the interior surface at the bottom of the liquid-refrigerant discharge valve seat 39' and the elastic body 56 is provided between the pedestal 57 and liquid-refrigerant discharge valve 45.

With the capacity control valve in Example 2, where the elastic body 56 that biases the liquid-refrigerant discharge valve 45 in the direction of opening the valve is provided, the control chamber pressure Pc causes the liquid-refrigerant discharge valve 45 to open, even when the pressure differential between the control chamber pressure Pc and intake chamber pressure Ps, which provides for a condition for discharging liquid refrigerant, is small, and consequently the intake-side passages 34, 35 are connected and liquid refrigerant, etc., collected in the control chamber 12 is discharged to the intake chamber 13 via the intake-side passages 34, 35.

When liquid refrigerant, etc., in the control chamber 12 is discharged and the control chamber pressure Pc drops to the specified level or lower, the bellows 51 extends and the liquid-refrigerant discharge valve 45 is seated on the liquid-refrigerant discharge valve seat 39' and closes.

When the solenoid 60 is large or otherwise the thrust force is ample, or when the bellows 51 load is high, the liquid-refrigerant discharge valve 45 does not open inadvertently during operation control. This means that an elastic body 55 that biases the liquid-refrigerant discharge valve 45 in the direction of closing the valve (refer to FIGS. 2 and 3) need not be provided.

EXAMPLE 3

The capacity control valve pertaining to Example 3 of the present invention is explained by referring to FIG. 6.

It should be noted that the same members used in Examples 1 and 2 are given the same symbols and redundant explanations are omitted.

The object of the capacity control valve in Example 3 is to expand the control range of liquid refrigerant discharge and allow liquid refrigerant to be discharged reliably.

Example 3 shown in FIG. 6 is characterized in that both the elastic body 55 that biases the liquid-refrigerant discharge valve 45 in the direction of closing the valve, and the elastic body 56 that biases the liquid-refrigerant discharge valve 45 in the direction of opening the valve, are provided.

In FIG. 6, the elastic body 55 that biases the liquid-refrigerant discharge valve 45 in the direction of closing the valve is provided between the adapter 52 and the solenoid-side interior wall surface 37*a* of the pressure-sensitive chamber 37, while the elastic body 56 that biases the liquid-refrigerant discharge valve 45 in the direction of opening the valve is provided at a position between the liquid-refrigerant discharge valve 45 and liquid-refrigerant discharge valve seat 39'.

When installing either the elastic body 55 that biases the liquid-refrigerant discharge valve 45 in the direction of closing the valve or the elastic body 56 that biases the liquid-refrigerant discharge valve 45 in the direction of opening the valve in order to achieve the object of each, as in Example 1 or Example 2, setting becomes difficult when assembling the elastic body if the spring load (load associated with the amount of extension/contraction at the time of installation) and spring constant are small.

On the other hand, providing both the elastic body 55 that functions in the valve closing direction and elastic body 56 that functions in the valve opening direction allows a biasing force to be set in either direction based on the difference between the elastic bodies 55, 56. This makes it possible to set a high spring load and large spring constant for both elastic bodies 55, 56.

Accordingly, the control range of liquid refrigerant discharge can be expanded and liquid refrigerant can be discharged reliably in this example.

As explained in Examples 1 through 3, the liquid-refrigerant discharge valve 45 and liquid-refrigerant discharge valve seat 39 or 39' proposed by the present invention are structurally simple and therefore the bore of the liquid-refrigerant discharge valve 45 can be set with ease to be greater or smaller than the effective diameter of the bellows 51, while adjusting the bore of the liquid-refrigerant discharge valve 45 is also easy.

For example, the liquid refrigerant discharge capacity can be improved, while extending the control limits at the same time, by adjusting the bore of the liquid-refrigerant discharge valve 45 under the present invention using any existing solenoid.

Here, if the bore of the liquid-refrigerant discharge valve 45 is increased, the liquid-refrigerant discharge capacity will increase but the control range in the low current range will be narrow.

If the bore of the liquid-refrigerant discharge valve 45 is decreased, on the other hand, the liquid-refrigerant discharge capacity will decrease but the control range in the low current range will be wide.

This means that, by optimally adjusting the bore of the liquid-refrigerant discharge valve 45, the liquid-refrigerant discharge capacity can be improved while widening the control range in the low current range at the same time.

As explained above, the capacity control valve proposed by the present invention is characterized by comprising: discharge-side passages 31, 32, 33 connecting a discharge chamber 11 that discharges fluid and a control chamber 12 that controls the discharge rate of fluid; a main valve chamber 36 formed midway along the discharge-side passages 31, 32, 33; a main valve 40 that opens and closes the discharge-side passages 31, 32, 33 in the main valve chamber 36; intake-side passages 34, 35 connecting an intake chamber 13 that takes in fluid and the control chamber 12; a pressure-sensitive chamber 37 formed midway along the intake-side passages 34, 35; a liquid-refrigerant discharge valve 45 that receives the pressure of the control chamber 12 to open and close the intake-side passages 34, 35; a pressure-sensitive body 50 placed in the pressure-sensitive chamber 37, which extends to apply a biasing force to the liquid-refrigerant discharge valve 45 in the direction of closing the valve, while contracting as the ambient pressure increases; and a solenoid 60 that applies an electromagnetic drive force to control the main valve 40; wherein the pressure-sensitive body 50 is supported on one side by the driving rod 65 of the solenoid 60 in a manner permitting relative motion, while connected on the other side to the liquid-refrigerant discharge valve 45, the result of which is that the discharge valve structure and discharge flow passages for discharging liquid refrigerant can be simplified and therefore the function of a variable-capacity compressor to discharge liquid refrigerant from its control chamber, at startup, can be improved. In addition, the bore of the liquid-refrigerant discharge valve can be made easily adjustable, which allows for discharge of liquid refrigerant while extending the control limits at the same time.

Modes for carrying out the present invention were explained above using the drawings, but specific constitutions are not at all limited to these embodiments, and changes and additions are also included in the scope of the present invention so long as they do not deviate from the key points of the present invention.

For example, the aforementioned embodiments explained cases where the liquid-refrigerant discharge valve and liquid-refrigerant discharge valve seat were shaped like a dish and a cup, respectively, but their shapes are not at all limited to the foregoing and, for instance, the liquid-refrigerant discharge valve may be shaped like a sphere and the liquid-refrigerant discharge valve seat, a cup or dish, so long as their shapes allow for setting a relatively large valve bore and make it easy to adjust the bore, and also permit an elastic body to be placed between the two.

DESCRIPTION OF SYMBOLS

10 Casing
11 Discharge chamber
12 Control chamber (crank chamber)
13 Intake chamber
14 Cylinder
15 Connection passage
16, 16' Connection passage
17 Connection passage
18 Connection passage
19 Fixed orifice
20 Rotational shaft
21 Swash plate
22 Piston
23 Connection member
24 Driven pulley
25 Condenser
26 Expansion valve
27 Evaporator
30 Body
31, 32, 33 Connection passage (discharge-side passage)
34, 35 Connection passage (intake-side passage)
36 Main valve chamber
36*a* Seating surface
37 Pressure-sensitive chamber
38 Guide passage
39, 39' Liquid-refrigerant discharge valve seat
40 Main valve
41 Seal member
45 Liquid-refrigerant discharge valve
50 Pressure-sensitive body
51 Bellows
52 Adapter
53 Holder
54 Spring
55 Elastic body
56 Elastic body
57 Pedestal
60 Solenoid
62 Casing
63 Sleeve
64 Fixed iron core
65 Driving rod
66 Movable iron core
67 Coil spring
68 Excitation coil
M Swash-plate type variable-capacity compressor
V Capacity control valve
Pd Discharge chamber pressure
Ps Intake chamber pressure
Pc Control chamber pressure

The invention claimed is:

1. A capacity control valve for controlling a variable-capacity compressor, the variable-capacity compressor having: an intake chamber that takes in fluid; a discharge chamber that discharges the fluid; and a control chamber that controls a discharge rate of the fluid, the capacity control valve comprising:

discharge-side passages connecting the discharge chamber and the control chamber;

a main valve chamber formed somewhere along the discharge-side passages;

a main valve that opens and closes the discharge-side passages in the main valve chamber;

intake-side passages connecting the intake chamber and the control chamber;

a pressure-sensitive chamber formed somewhere along the intake-side passages;

a liquid-refrigerant discharge valve including a movable valve body that receives a pressure of the control chamber to open and close the intake-side passages;

a pressure-sensitive body placed in the pressure-sensitive chamber, which extends to apply a biasing force to the liquid-refrigerant discharge valve in a direction of closing the liquid-refrigerant discharge valve, while contracting as an ambient pressure increases; and a solenoid having a coil that generates an electromagnetic drive force to control the main valve;

wherein when the coil of the solenoid is energized with a specified or greater current, the discharge-side passages are blocked by the main valve, and wherein the pressure-sensitive body is supported on one side by a driving rod of the solenoid in a manner permitting motion relative to the driving rod, while connected on the other side to the movable valve body of the liquid-refrigerant discharge valve.

2. A capacity control valve according to claim 1, wherein an elastic body is provided that pressurizes the movable valve body of the liquid-refrigerant discharge valve in a direction of closing the liquid-refrigerant discharge valve.

3. A capacity control valve according to claim 1, wherein an elastic body is provided that pressurizes the movable valve body of the liquid-refrigerant discharge valve in a direction of opening the liquid-refrigerant discharge valve.

4. A capacity control valve according to claim 1, wherein an elastic body is provided that pressurizes the movable valve body of the liquid-refrigerant discharge valve in a direction of closing the liquid-refrigerant discharge valve, along with an elastic body that pressurizes the movable valve body of the liquid-refrigerant discharge valve in a direction of opening the liquid-refrigerant discharge valve.

* * * * *